United States Patent [19]

Mock

[11] 4,302,318

[45] Nov. 24, 1981

[54] MEANS FOR RECOVERING SILVER FROM PHOTO CHEMICALS

[76] Inventor: Karl J. Mock, 685 Bogert Rd., River Edge, N.J. 07661

[21] Appl. No.: 134,431

[22] Filed: Mar. 27, 1980

Related U.S. Application Data

[63] Continuation-in-part of Ser. No. 673,594, Apr. 5, 1976, which is a continuation of Ser. No. 354,432, Apr. 25, 1973, abandoned.

[51] Int. Cl.[3] ..... C25D 21/12; C25C 7/00; C25C 1/20

[52] U.S. Cl. ..... 204/229; 204/109; 204/272; 204/273; 204/275

[58] Field of Search ..... 204/109, 228, 272, 273, 204/229, 275

[56] References Cited

U.S. PATENT DOCUMENTS

| | | | |
|---|---|---|---|
| 3,477,926 | 11/1969 | Snow et al. | 204/109 |
| 3,583,897 | 6/1971 | Fulweiler | 204/273 X |
| 3,694,341 | 9/1972 | Luck, Jr. | 204/273 |
| 3,702,814 | 11/1972 | Mandroian | 204/273 X |
| 3,715,299 | 2/1973 | Anderson et al. | 204/109 X |
| 3,925,184 | 12/1975 | Cave | 204/229 |
| 3,926,768 | 12/1975 | Burgess | 204/273 X |
| 3,959,110 | 5/1976 | Burgess | 204/109 X |

*Primary Examiner*—Donald R. Valentine

*Attorney, Agent, or Firm*—Hopgood, Calimafde, Kalil, Blaustein & Judlowe

[57] ABSTRACT

The invention illustratively contemplates recovery of silver from waste photographic-fixer solution, the apparatus being so devised and controlled that high purity is achieved in the reclaimed metal without contamination of the remaining solution. As a result, the remaining solution may be recycled, and requirements for replenishment of fixer chemical are held to minimum quantities. In an automated employment of the invention, assurance is provided that electroplating action will be called for only when it can be safely performed, without impairment of quality in the reclaimed metal or in the recycled solution.

28 Claims, 10 Drawing Figures

MEANS FOR RECOVERING SILVER FROM PHOTO CHEMICALS

BACKGROUND OF THE INVENTION

This application is a continuation-in-part of my copending application Ser. No. 673,594, filed Apr. 5, 1976, and said copending application is a continuation of my original application Ser. No. 354,432, filed Apr. 25, 1973 (now abandoned).

This invention relates to recovery of precious metal from a solution containing the same, and is illustratively described in connection with silver-recovery apparatus for use with waste photographic-fixer solution.

Conventional apparatus of the character indicated employs carbon anodes which are subject to gradual disintegration, thus providing a contaminant for the solution and giving rise to a variable plating-current density, as the electrode is consumed. The solution is not reusable, and the recovery of silver is only in the order of 40 to 60 percent of that which is available. Moreover, the silver that is recovered is not of the best quality, so that further refining steps are needed. In general, the shortcomings of the conventional technique limit its use essentially to large commercial photo processing firms and laboratories, and the matter of anode servicing and replacement is a major maintenance factor.

BRIEF STATEMENT OF THE INVENTION

It is accordingly an object of the invention to provide improved apparatus of the character indicated.

Another object is to provide such apparatus which will inherently produce substantially greater yields of metallic silver, far exceeding 90 percent of that available, and at the same time yielding higher-quality silver than heretofore, namely, silver of merchantable quality.

A further object is to meet the above objects with apparatus that is relatively small, odor-free, and simple to maintain and which can therefore serve institutions, such as hospitals, which only incidentally must perform their photographic processing of X-ray negatives.

A specific object is to provide a device of the character indicated which will permit recycled use of fixer solution from which substantially all silver has been recovered.

Another specific object is to provide a device of the character indicated with means whereby it can function in conjunction with automatic or semi-automatic photoprocessing installations.

Other objects and various further features of the invention are illustrative realized in a system for recovery of silver from waste photographic-fixer solution, the apparatus being so devised and controlled that high purity is achieved in the reclaimed metal without contamination of the remaining solution. As a result, the remaining solution may be recycled, and requirements for replenishment of fixer chemical are held to minimum quantities.

DETAILED DESCRIPTION

The invention will be illustratively described in conjunction with the accompanying drawings, in which.

Figure 1:
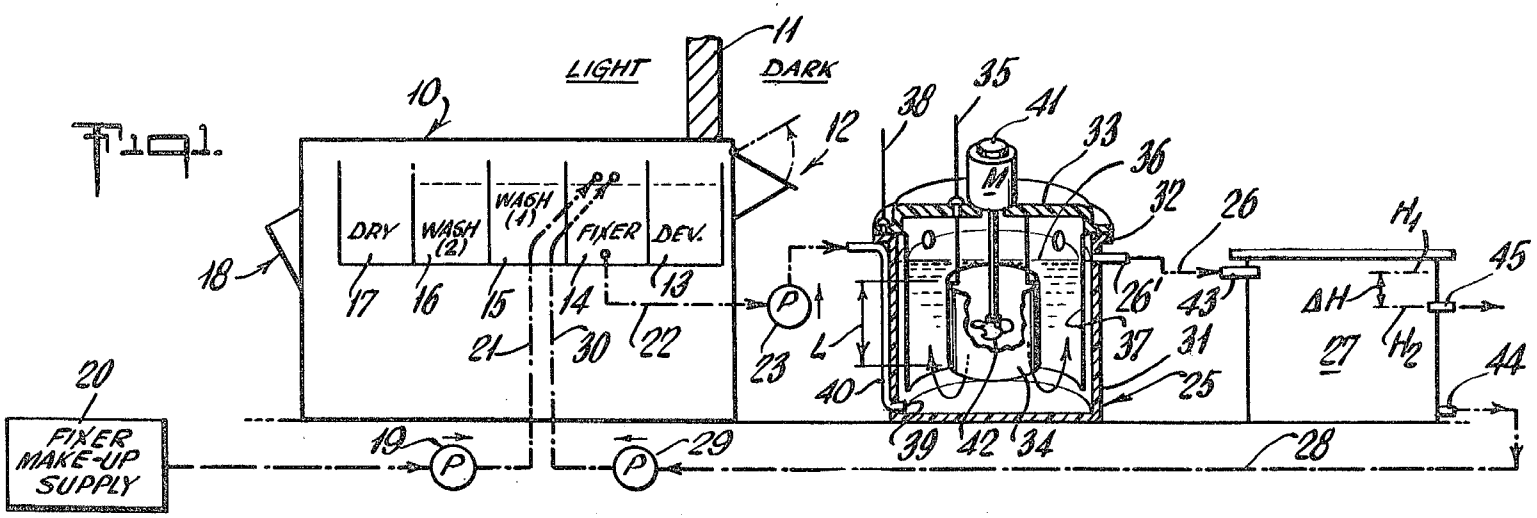
FIG. 1 is a simplified diagram schematically indicating components of a silver-recovery system of the invention.

In FIG. 1, the invention is shown in application to an intermittently operative or semi-automatic photodevelopment system, such as a machine 10 customarily installed in hospitals for development of X-ray negatives, promptly after exposure. The machine is installed in the wall 11 of a dark room where means 12 provides loading access, i.e., access for insertion of each exposed negative to be developed. Within the machine is a succession of tanks, for developer solution at 13, fixer solution at 14, and first and second washing or rinsing steps at 15–16. The machine 10 will be understood to include means (not shown) for the automatic transport of the inserted negative, into the developer at 13, thence to the successive baths 14–15–16, in timed sequence appropriate to the desired processing of the negative. The machine 10 will also be understood to include drying means (suggested at 17) preparatory to automatic delivery of the dried film at a delivery-access tray or door 18 outside the dark room.

The fixer-related part of machine 10 may include means such as a pump 19 connected to a supply 20 of fixer solution, for make-up or replenishment of the contents of bath 14, the same being shown connected via line 21 to discharge directly into bath 14. An overflow or exhaust line 33, which may be operated by pump means 23, delivers excess used (silver-laden) fixer solution to a plating tank 25 of the invention, and tank 25 exhausts in a line 26 to a holding tank 27 forming part of return line 28–30, with pump means 29 for recycling the use of fixer solution at bath 14.

Basically, the plating tank 25 comprises an upwardly open cupped body 31 having a radial flange 32 for support and fastening of the flanged rim of a removable cover 33. The tank parts 31–32 present electrically insulated walls, both inside and outside, and may conveniently be of glass-fiber reinforced epoxy or other resin, molded to desired generally cylindrical internal contour. An open-ended cylindrical anode 34 is centrally suspended from the cover 33, one suspension point being provided with a terminal-lead connection 35; the effective cylindrical length L of anode 34 is fully submerged in fixer solution, i.e., spaced from the tank bottom and beneath the liquid level 36 established by placement of the overflow port 26' to line 26. An open-ended cylindrical cathode 37 concentrically surrounds the anode and is shown adjacent the tank wall, spaced from the tank bottom and having an upper flange by which it seats upon the tank-body flange 32; a lead connection to the cathode flange is externally accessible at 38. Inlet liquid from means 22–23 enters the lower part of tank 25 at a port 39 beneath the cathode, said port being shown as the bent lower end of a vertical pipe 40 which extends above the liquid level 36 and which is preferably embedded in the tank body of the course of manufacture; such construction will be recognized as permitting simple detachable connection of hose or other supply plumbing, without having to drain the tank 25, and without weakening the anchorage of port 39. Finally, an electric motor 41 secured to cover 33 includes a shaft and impeller 42 extending concentrically within the anode, to promote a gentle toroidal flow as long as plating potential is applied at 35–38; preferably, the direction of such impelled flow is as suggested by arrows, namely, downward within the anode 34, radially outward beneath the anode, upward between the electrodes 34–37, and radially inward above the anode.

The holding tank 27 may be a simple covered vessel having inlet and outlet ports 43–44 forming part of the recycling circuit already described. However, the periodic addition of make-up solution from supply 20 creates a need for discharge of excess processed solution, preferably at tank 27. This need may be met by a simple overflow drain port 45 or, if desired, automatic valve means (not shown) may be provided to permit accumulation to an upper level $H_1$ before release via port 45, thus effecting relatively infrequent discharge of the head or difference $\Delta H$ between upper and lower levels $H_1$–$H_2$.

Figure 2:
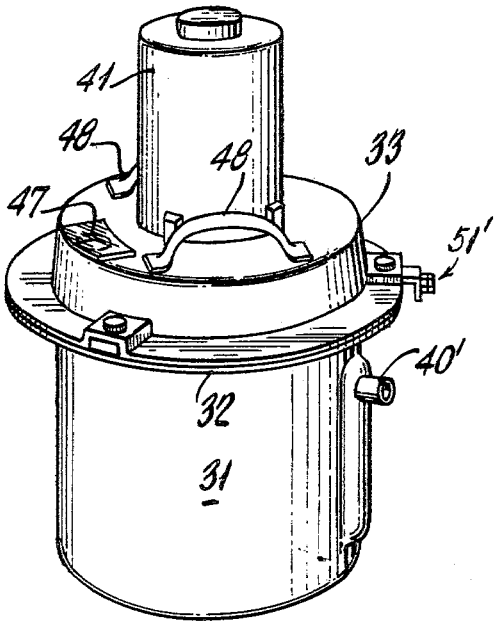
FIG. 2 is a perspective view of a silver-recovery tank unit, forming part of the system of FIG. 1.
Figure 3:
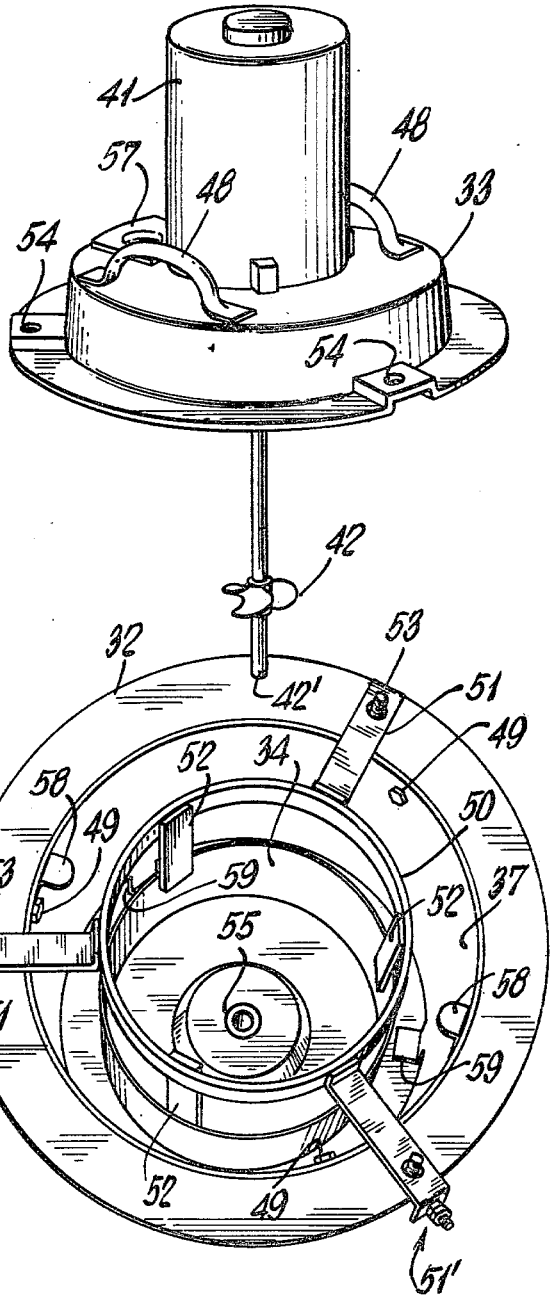
FIG. 3 is an exploded view in perspective showing removal of the cover assembly from the tank unit of FIG. 2, as for servicing or inspection.

FIGS. 2 and 3 show greater detail of a plating tank which differs only slightly from the plating tank described in connection with FIG. 1; for this reason, the same reference numbers are adopted for the same or corresponding parts. The inlet pipe 40 is seen to be embedded in the tank-body material and to present a standard fitting 40' for detachable plumbing connection. A window 47 in cover 33 permits viewing of tank contents without disturbing a secured closure of the tank, and spaced handles 48 on the cover provide simplified manipulation of the cover and all parts subassembled thereto.

In FIGS. 2 and 3 there are differences in detail (compared to FIG. 1) as to the manner of support of the anode and cathode members 34–37, but their placement and effective areas remain the same. Specifically, the cathode 37 fits closely to the inner wall surface of the tank body 31, and is positioned just below the level of flange 32, being held in place by spaced radial bolts 49 which are above the level 36 and which extend through the body 31; one of these bolts 49 has an extended shank 49' and serves as the cathode-lead terminal. The anode 34 is suspended from a spider structure comprising an upper ring 50 and spaced radially outward arms 51; ring 50 is of substantially the diameter of the anode, and spaced straps 52 tie the inner wall of the anode to the suspension ring 50. A projection or bracket formation 51' on one of the arms 51 provides electrical lead-connection access to the anode 34. Mounting holes in arms 51 locate on upstanding studs 53, which are preferably anchored in the plastic body of flange 32.

The tank assembly is secured by applying a suitable gasket (not shown) to flange 32 before registration of cover holes 54 with studs 53, at which time stud nuts may be applied. The application of nuts to studs 53 is found to be necessary only to discourage tampering, because entirely satisfactory performance is achieved by merely placing the cover assembly over the tank-body assembly.

As to the impeller 42, good toroidal flow is achieved for a variety of axial placements. Generally, it is preferred that the impeller be located within the anode, at least below the upper end of the anode, and it may be as low as the bottom surface of the tank. If the impeller is located near the lower end of the anode, it is desired to use the tank bottom as a stabilizing reference for impeller-shaft rotation. Thus, in FIG. 3, a bearing 55 such as a nylon or Mylar bushing is shown embedded at the center of the tank bottom, for guided reception of the projecting end 42' of the impeller shaft.

The drawings reflect preference for the use of stainless sheet-metal electrodes 34–37 and associated suspension structure. In a highly satisfactory employment of the invention, each electrode is of type 316 stainless steel, approximately 1/16-inch thick, although thickness in the range of 0.015 to 0.150 inch will also be satisfactory. A cathode diameter of 16 inches is well accommodated in a tank bore of $16\frac{1}{8}$ inches, and an associated anode of 8-inch diameter provides an effective relationship. Of course, electrode length is a function of tank capacity; for five or ten-gallon capacity, anode length is approximately five or ten inches, respectively, and cathode lengths are scaled accordingly. Titanium bolts are preferred at 49–53.

Figure 4:
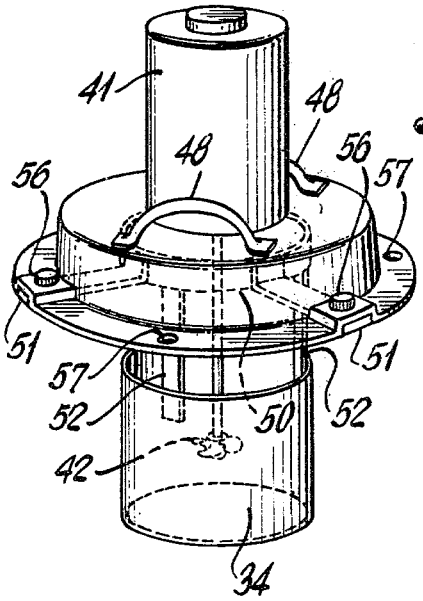
FIG. 4 is a similar view of an alternative cover assembly.

FIG. 4 illustrates a slightly modified cover assembly wherein the anode 34 and its suspension structure 50–51–52 are secured by bolt means 56 to the flange of cover 33. Mounting holes 57 in this flange register with studs 53, to secure the full tank assembly. And the shaft for impeller 42 is short enough to be fully contained within the included volume of the anode 34. Thus, upon removal of the cover assembly, it may be stood to the side of the tank body 31, resting upon the base of the anode 34.

In the periodic servicing of the described plating-tank structures, the cover assembly is removed and the anode assembly is removed. Access is then presented for removal of the cathode, the bore of which may be laden with as much as a one-inch thickness of high-quality metallic silver; in FIG. 3, inward brackets 58 at diametrically opposite locations on the cathode provide lifting access for removal of the cathode, while positioning feet 59 maintain a desired spacing from the tank bottom and also provide a convenient footing when the cathode is removed from the tank. Metal silver is then removed from the cathode by fracturing, as by sharp application of one or more mallet blows to the outer surface of the cathode; alternatively, the silver may be removed by melting. Both electrodes may then be immediately restored to service, although as a practical matter, a substitute cathode will probably be installed, to permit the loaded cathode to be shipped remotely, for silver removal and then for reuse.

Figure 5:
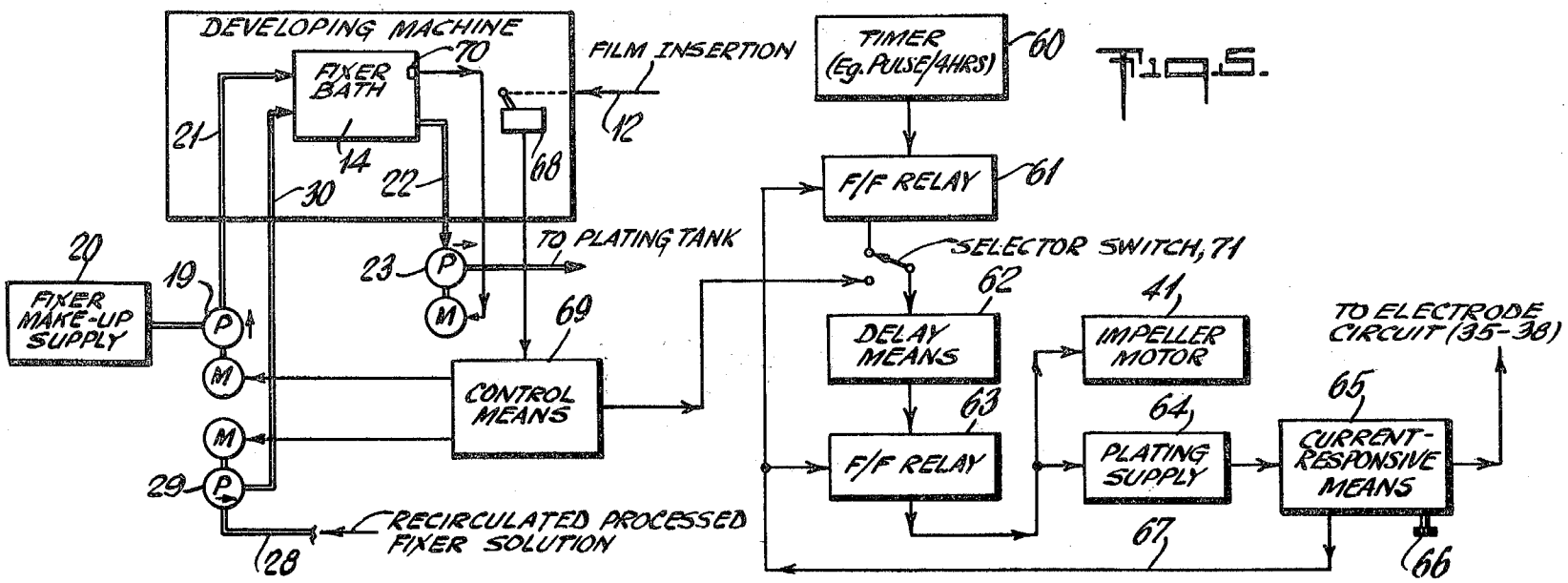
FIG. 5 is an electrical and hydraulic circuit diagram, to show means for implementing use of the system of FIG. 1.

The circuit diagram of FIG. 5 shows two control arrangements, either or both of which may be used in the automatic operation of the described system. One of these control techniques, shown available for the "up" position of a selector switch 71, relies upon a timer 60, which may be set to deliver a control pulse once for each given selected interval, for example one pulse every four hours. This pulse is shown connected to a bistable flip-flop relay 61, the connection being such that a starting signal is imparted via delay means 62 to another flip-flop relay 63; it being understood that passage of a predetermined delay at 62 is a condition precedent to establishing a starting condition of relay 63. Once relay 63 operates, excitation controls are established for the impeller motor 41 and for the plating supply 64 to the electrode circuit 35–38. Included in one arm of this circuit is current-responsive means 65, set by selectively adjustable means 66, to produce an output signal in a control line 67 should the detected plating-circuit current be less than a predetermined level. Such a signal in line 67 is used, by connection to the relays 61–63, to disable the starting mechanism, thereby avoiding a start up should the current level be of pre-selected insufficient amplitude. It will be understood that that delay at 62 should be at least sufficient to assure termination of the timer pulse at 69, before excitation of the plating circuit. By this means, one is assured that, if inadequate plating-circuit current flow is detected, then the timer 60 will be ineffective to attempt another plating start-up, until passage of the selected time interval for the next pulse, here assumed to be another four hours.

The other control technique, which may be concurrently operative with timer 60, but which through selector-switch operation may be the sole operating control for the plating circuit, relies upon operation of the developing machine 10. As shown, this machine includes a limit switch 68 having a probe arm poised to respond to a film insertion at 12. Such a switch 68 or its equivalent is to be found in most photo-developing machines and is relied upon, via suitable control means 69, to operate valves or to drive displacement pumps for the predetermined incremental supply of replenishment developer and fixer, from make-up supplies of stock solution; the present situation is concerned solely with adaptation to the fixer solution and its supply 20, which will be understood to be briefly drawn, to the extent of a predetermined volume $V_1$ by operation of pump 19 under the control of means 69. Concurrently, control means 69 is connected to pump means 29 to deliver into bath 14 a predetermined volume $V_2$ of recycling fixer solution, from the holding tank 27; and control means 69 is further connected to provide a starting input to the delay means 62. It will be understood that adjustments are made to assure a correct proportioning of the indicated volumes, such that the minimum necessary fresh chemicals are drawn from the supply 20. At the same time, means 70 responsive to fixer level in bath 14 is operatively connected to pump means 23 to draw off used, silver-laden fixer from tank 14, in a quantity to maintain the desired fixer-bath level.

The used fixer is of course supplied directly to tank 25, and it may contain enough silver enrichment to the contents of tank 25 to enable a plating operation. This condition is tested by the current-responsive means 65, already described. If there is an inadequate current, the plating circuit is restored to shut-down condition, but if the current is at an adequate level, the described toroidal flow and plating action proceed, until means 65 functions to shut down the plating through having detected the minimum acceptable current level.

It will be seen that the invention meets all stated objects with a relatively simple and inherently clean plating-tank structure. The arrangement, control and choice of materials are such that electrodes are repeatedly reusable; more than 98 percent of the available silver is reclaimable; the processed fixer is recycled; no gases are given off to the surrounding space (which in the case of a hospital dark room is very confined); and no solution is "burned" by excessive current at high voltage. For example, for the indicated anode and cathode dimensions, and for a relatively high plating potential of 5 volts, current can range up to 15 amperes without burning the silver, but preferably the current is held to a level in the range 2 to 7.5 amperes; the maximum current being determined by assuring sufficiently frequent attempts at plating, as by shortening the pulse interval at timer 60 should the fixer bath be called upon to carry heavy and continuous use.

While the invention has been described in detail for the preferred forms shown, it will be understood that modifications may be made without departing from the invention. For example, by reversing the polarity of plating potential applied to the electrodes 34–37, the outer electrode becomes the anode and the inner electrode becomes the cathode, in which case metallic silver is plated upon the outer surface of the inner electrode. Use of the expressions "cathode" and "anode" in application to the electrodes 34–37 will thus be understood to be illustrative, rather than limiting, in the present context.

Development of the described toroidal flow is inherent in the plating action of the described electroplating tank unit 25, the function of impeller 42 being merely to produce flow in the same direction and therefore to provide a means for enhancing such flow. And it is helpful to briefly discuss the inherent flow-inducement plating function of tank 25 in conjunction with FIG. 6, as an introduction to description of the further embodiments of FIGS. 7 to 10.

Figure 6:
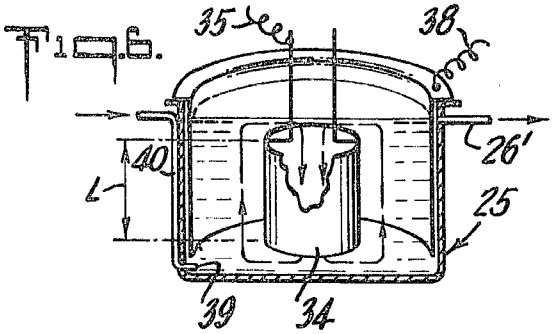
FIG. 6 is a simplified view of a silver-recovery unit, in the style of FIG. 1, to illustrate inherent recirculatory flow by reason of electroplating action.

In FIG. 6, the mechanical impeller 42 has been omitted, in order to limit discussion to the toroidally recirculating flow-inducement function inherent in application of plating potential to the leads 35–38 for the concentric electrodes 34–37 of the tank unit 25 of FIG. 1. The flow arrows of FIG. 6 delineate the direction of toroidal flow, namely, downward in an inner zone within the inner electrode 34, and upward in the annular zone between electrodes 34–37, radially outward crossover between these zones being possible in the bottom clearance beneath the lower end of inner electrode 34, and radially inward crossover between these zones being possible in the upper region where the upper end of electrode 34 is beneath the tank-capacity level of spillway 26'. Before application of plating potential, the waste photo-chemicals which fill the tank provide a relatively dense electrolyte solution containing silver ions, and this density is locally reduced in the annular region between electrodes 34–37 by reason of plate-out to the cathode surface. Having thus locally reduced solution density, the heavier solution within the inner electrode 34 gravitationally seeks equilibrium with remaining solution, inherently displacing less-dense solution upwardly in and from the plating zone, to then spill over into the inner zone within electrode 34. For the relatively low current densities involved in the described plating operation, only some of the silver ions are plated-out for each pass upward through the plating zone. As a result, the torodial flow indicated by arrows proceeds continuously until substantial exhaustion of the silver content of the solution, and if new waste solution is introduced via inlet 40, the toroidal-flow process continues.

Figure 7:
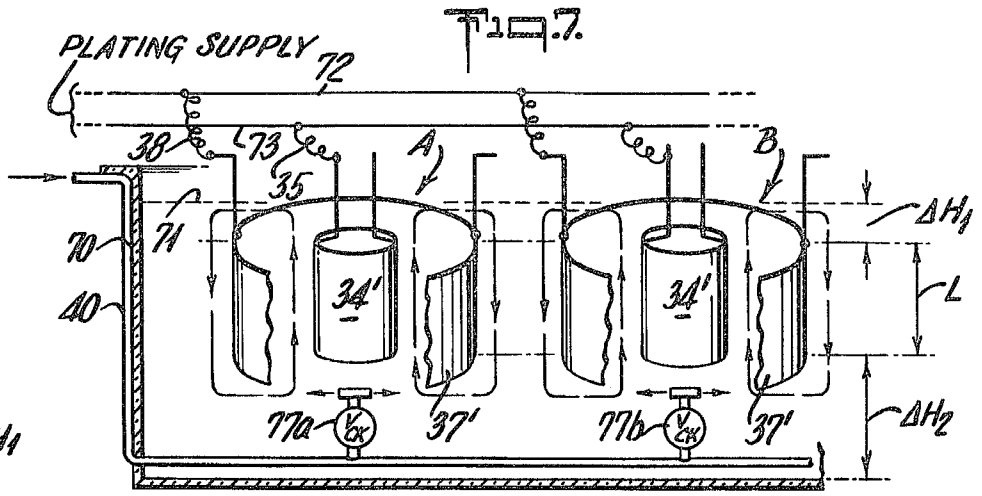
FIG. 7 is a fragmentary simplified diagram to illustrate a modified silver-recovery unit and its adaptability to use in multiple.

In the arrangement of FIG. 7, a plurality of plating-electrode pairs A, B, etc. are supported in laterally spaced relation, from each other and from wall structure 70. The inner electrode 30' of each pair may be as described at 34 in connection with FIG. 1, but for purposes of initial discussion it will be assumed to be closed internally but nevertheless presenting an operative outer cylindrical surface for establishment of plating potential with respect to the concentrically disposed cylindrical open-ended outer electrode 37'. In contrast to FIG. 1, it is the outer electrode 37' which is of length L and fully submerged a distance $\Delta H_1$ below the capacity level 71 and a distance $\Delta H_2$ above the tank bottom. Upon application of plating potential, as via bus bars 72–73 to corresponding electrodes of each pair A, B, etc., it is again the annular plating zone (between electrodes of each pair) which develops reduced density through plate-out action, and since solution external to the outer electrode 37' is more dense, toroidal flow develops around electrode 37' by reason of the density differential and by reason of the freedom for solution to crossover radially inward beneath electrode 37', with radially outward spillover above electrode 37', all as indicated by directional arrows for the plural electrode pairs A, B, etc.

Figure 8:
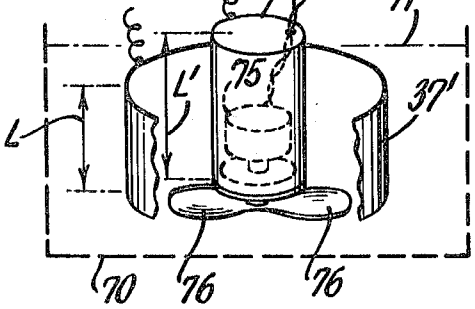
FIG. 8 is a diagram similar to FIG. 6 to show inherent recirculatory flow by reason of electroplating action in each unit of the modification of FIG. 7.

FIG. 8 illustrates the nature of double-toroidal flow, induced by plating action when both electrodes 34'–37' of a given electrode pair (or of each electrode pair in FIG. 7) are open-ended, fully immersed $\Delta H_1$ below the spillway level 71 and spaced $\Delta H_2$ above the tank bottom. In this case, the first toroidal path may be as described for FIG. 6, namely about the inner electrode 34' as the core of the first toroid, and the second toroidal path may be as described for FIG. 8, namely about the outer electrode 37' as the core of the second toroid, it being noted that the upward flow in the intermediate annulus or plating zone between electrodes 34'–37' is a flow that is shared by the two toroidal-flow paths. In all cases (FIGS. 6, 7 and 8), it matters not whether the inner electrode is an anode or a cathode, but preference is indicated for the outer electrode to be the cathode, in view of the larger plate-out area it affords.

Figure 9:
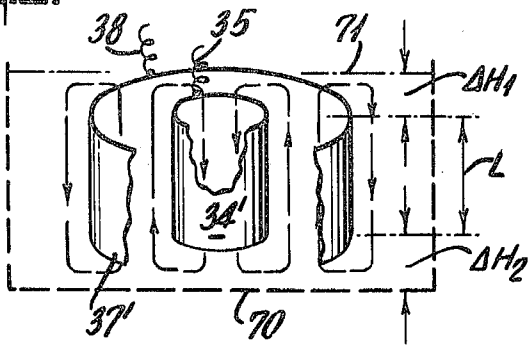
FIG. 9 is another simplified diagram to show a further silver-recovery unit.

It will be understood that for enhancement of the toroidal-flow action in an electrode configuration in which the inner electrode 34' is open-ended and fully immersed and spaced from the tank bottom, as for the case of FIG. 8, the central impeller 42 may be provided in the manner discussed for inner electrode 34 in the tank unit 25 of FIG. 1. In such event, it is preferred that the impeller-drive means be located above the capacity level 71. However, for the case of a closed-end inner electrode, there is no reliance upon flow inside the inner electrode and therefore the upper end of such inner electrode may be above the capacity level 71, to permit non-corrosive electric-cable access to an impeller motor contained within the inner electrode. Such an arrangement is depicted in FIG. 9, wherein the inner electrode 34'' is of length L' greater than the length L of the fully immersed outer electrode 37'. The two electrodes are spaced $\Delta H_2$ from the tank bottom (as in FIG. 8), but the greater length L' of electrode 37'' is enough to place the upper closed end thereof above level 71. A motor 75 within electrode 37'' will be understood to incorporate adequate gear reduction so that only the most gentle and slow enhancement of flow is attributable to the action of its impeller blades 76.

In situations in which multiple pairs of electrodes A, B, etc. are arrayed in laterally spaced relation, as in the tank 70 of FIG. 7, it is desirable that each plating zone be given substantially equal shares of new electrolyte solution via inlet 40. To provide such sharing, the inlet 40 in FIG. 7 is shown serving plural individual inlet-discharge points, each at the outlet of a check valve, such as the valve **77*a* serving the electrode pair A and the valve 77*b* serving the electrode pair B. It will be understood that by appropriate design and/or adjustment, equal-volume injections of new silver-laden fixer solution will occur at 77*a*, 77*b*, etc. for each operation of the pump 23 which serves inlet 40**.

In spite of efforts made, as just described, to assure equal sharing of plating load at each electrode pair, it is possible that one or more electrode pairs may locally exhaust their supply of silver-laden fixer solution before one or more other electrode pairs are able to achieve the same yield. This circumstance can be noted by having separate current-responsive means 65 associated with the plating circuit to each electrode pair, thus enabling each such means 65 to locally terminate plating action when the predetermined low current level is locally achieved.

Figure 10:
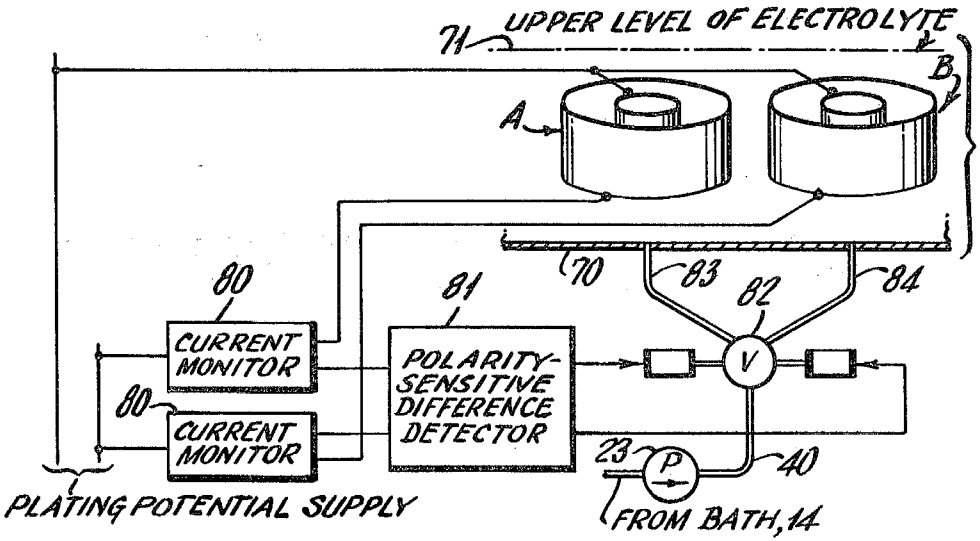
FIG. 10 is an electrical and hydraulic circuit diagram to show control means operative in the modification of FIG. 7.

Alternatively, and as illustrated in FIG. 10, current-responsive means 80 associated with each plating circuit may monitor the instantaneous level of current to develop a suitable current-indicating output signal, and further means 81 may be connected for response to a plurality of such output signals to sense whether current consumption in any particular circuit exceeds a predetermined amount less than the current consumption in one or more other circuits. For the case shown, in which two electrode pairs A-B are served, the means 81 is a polarity-sensitive difference detector, having separate control output connections to first and second operating solenoids of a directional valve 82 in the fixer supply line 40 to bath 70; and depending on which solenoid is excited, fixer solution will be preferentially delivered via line 83 to the electrode pair A or via line 84 to the electrode pair B, it being understood that if neither solenoid is excited, any operation of pump 23 will deliver substantially equal division of the new silver-laden electrolyte solution, in both lines 83 and 84. Thus, if the current differential is observed by means 81 to be in the polarity sense indicative of lower current consumption by electrode pair A (than the current consumption of pair B), and if the magnitude of this differential exceeds the predetermined amount, then the correct solenoid of valve 82 will be actuated to divert the next discharge by pump 23 into the line 83, or at least to a greater extent into line 83 than into line 84; and when the current consumed at A is seen to rise such that the predetermined differential at 81 no longer exists, then the solenoid of valve 82 will be de-energized to allow valve 82 to return to its mid-position wherein lines 83 and 84 share equally in the flow from pump 23.

It will be understood that the principle of FIG. 10, wherein fresh silver-laden solution is preferentially routed to the electrode pair doing the least work, can be applied to contexts wherein more than two electrode pairs are operating concurrently. In such case, for example, automatic electrical sensing means exist whereby any electrode pair which is detected to be drawing, to a predetermined extent, less current than the pair drawing the greatest current, will be automatically served with a greater share of silver-laden solution next-delivered by pump 23. The FIG. 10 arrangement thus merely serves to illustrate the multiple-pair situation wherein the number of electrode pairs is two.

The invention has been particularly described for the specific case of recovering silver from waste photographic fixer solution. But the invention will be seen to be broadly applicable to the recovery of elementary metals such as precious metals from any electrolytic solution which contains ions of the metal to be recovered. Electrode surfaces may be of materials other than described, but stainless steel is preferred for durability, for non-contamination of high-quality plating accumulation, and for ease of removal of the plating accumulation.

What is claimed is:

1. An electrochemical device for recovering a precious metal from an electrolyte solution containing ions of said precious metal, comprising a tank with a bottom and sidewall having a predetermined upper level of liquid capacity, first and second electrodes having radially spaced cylindrical surfaces and mounted on a common upstanding axis, the outer one of said electrodes being totally beneath said predetermined level and above the bottom of said tank, said outer electrode being also at least in part in lateral clearance with said sidewall, and impeller means operative beneath said level to develop a recirculatory flow of liquid in said tank and toroidally about said outer electrode, the direction of operation of said impeller means being such as to induce upward flow in the space between said electrodes.

2. The electrochemical device of claim 1, in which said impeller means comprises means for applying polarized plating potential to said electrodes, whereby when filled with solution to said level, the precious metal will plate out of solution in the region between said electrodes, thereby locally reducing the specific gravity of the solution and allowing more-dense solution from radially outside said outer electrode to flow radially inwardly below said outer electrode to replenish and upwardly displace plated-out solution in said region between electrodes, upwardly displaced solution spilling radially outward as less-dense solution over the top of said outer electrode while the more-dense solution radially outward of said outer electrode enters the space between said electrodes via the space beneath said outer electrode.

3. The electrochemical device of claim 1, in which said impeller means includes blades mounted for driven rotation beneath said level.

4. The electrochemical device of claim 1, in which said outer electrode is substantially circumferentially continuously spaced from said sidewall.

5. The electrochemical device of claim 1, in which said electrodes constitute one pair of a plurality of similar pairs of electrodes similarly mounted in laterally spaced relation in said tank.

6. The electrochemical device of claim 5, in which said electrode pairs are interconnected for electrical excitation with plating potential across the electrodes of each pair.

7. The electrochemical device of claim 6, in which said electrode pairs are interconnected in parallel.

8. The electrochemical device of claim 6, in which said tank includes provision for independent supply of new electrolyte solution to the toroidal flow path unique to each electrode pair, means associated with said supply for varying the proportion of new electrolyte flow supplied to one as compared to another of said electrode-pair flow paths, means comparatively monitoring plating current flow to the respective electrode pairs, and a control connection from said monitoring means to said proportion varying means, the directional sense of said control connection being to increase new-electrolyte flow to the electrode-pair flow path exhibiting lesser electric current consumption.

9. The electrochemical device of claim 6, in which said tank includes provision for independent supply of new electrolyte solution to the toroidal flow path unique to each electrode pair, means associated with said supply for varying the proportion of new electrolyte flow supplied to one as compared to another of said electrode-pair flow paths, means comparatively monitoring plating current flow to the respective electrode pairs, and a control connection from said monitoring means to said proportion varying means, the directional sense of said control connection being to decrease new-electrolyte flow to the electode-pair flow path exhibiting greater electric current consumption.

10. The electrochemical device of claim 1, in which said inner electrode is open-ended and totally beneath said predetermined level and axially spaced from the tank bottom, whereby a second recirculatory flow of liquid in said tank is toroidal about said inner electrode and shares with said first-defined toroidal recirculatory flow the upward flow induced in the space between said electrodes.

11. An electrochemical device for recovering a precious metal from an electrolyte solution containing ions of said precious metal, comprising a tank with a bottom and sidewall having a predetermined upper level of liquid capacity, first and second electrodes having radially spaced cylindrical surfaces and mounted on a common upstanding axis, the outer one of said electrodes being totally beneath said predetermined level and above the bottom of said tank, said outer electrode being also at least in part in lateral clearance with said sidewall, and impeller means including blades mounted for driven rotation beneath said level to develop a recirculatory flow of liquid in said tank and toroidally about said outer electrode, the direction of operation of said impeller means being such as to induce upward flow in the space between said electrodes, said inner electrode being closed at its ends and containing motor means for imparting blade rotation about said axis.

12. An electrochemical device for recovering silver from waste photographic-fixer solution, comprising a tank with a bottom and sidewall having a predetermined upper level of liquid capacity, an open-ended stationary cylindrical cathode supported on a vertical axis within said tank and above the bottom and totally beneath said predetermined level, a stationary anode concentrically supported in radially spaced relation with said cathode, said cathode being at least in part in lateral clearance with said sidewall, and impeller means positioned beneath said level to develop a recirculatory toroidal flow of liquid in said tank and about said cathode, the direction of operation of said impeller means being such as to induce upward flow in the space between said anode and cathode.

13. The electrochemical devices of claim 12, in which said anode is open at its axial ends and is also positioned totally beneath said predetermined level and above the bottom of said tank.

14. An electrochemical device for recovering silver from waste photographic-fixer solution, comprising a tank having an upwardly open end and a cover removably securable over the open end of said tank, said tank having an upper spillway port predetermining a liquid-capacity level within the tank, said tank having an inlet port communicating with the bottom region within the tank, a cylindrical first electrode of stainless metal fixedly supported by said cover on an upstanding axis and extending into said tank beneath said level, a fixedly positioned hollow cylindrical second electrode of stainless metal having upper and lower open ends and concentrically surrounding and radially spaced from said first electrode, said second electrode having its upper end below said level and its lower end above said bottom region, and flow-impelling means spaced from said electrodes and operative beneath said level and positioned to establish a recirculating toroidal liquid flow in opposite axial directions on the respective inner and outer sides of said second electrode.

15. A device according to claim 14, wherein the inlet port is at the lower end of said second electrode.

16. A device according to claim 14, wherein the inlet port is at the bottom of said tank and within the geometric vertical projection of the cylinder of said second electrode.

17. A device according to claim 14, wherein said electrodes are oppositely polarized as anode and cathode, respectively, and said impelling means is driven in the direction of producing downward flow outside said second electrode and upward flow within the space between said electrodes.

18. A device according to claim 14, in which said first electrode is hollow and open-ended and is also positioned totally beneath said level and above the tank bottom.

19. A device according to claim 14, in which said flow-impelling means comprises a motor mounted on said cover and an impeller shaft driven by said motor and extending coaxially within said first electrode, and an impeller on said shaft in the region beneath said first electrode.

20. A device according to claim 14, in which said first electrode and impelling means are carried as a unit-handling assembly with said cover.

21. An electrochemical device for recovering silver from waste photographic-fixer solution, comprising an upwardly open tank having a sidewall with a predetermined upper level of liquid capacity, a hollow open-ended stationary cylindrical anode positioned in said tank on an upstanding axis and located in clearance relation above the tank bottom and beneath said level, flow-impelling means generally on the anode axis for generating a recirculating toroidal flow of liquid in opposite axial directions on the respective inner and outer sides of said anode, and an open-ended stationary cylindrical cathode surrounding and radially spaced from said anode and positioned for exposure to the axial direction of flow outside said anode, said cylindrical cathode being laterally spaced from said sidewall and located in clearance relation above the tank bottom and beneath said level, whereby a second toroidal flow of liquid is established in opposite axial directions on the respective inner and outer sides of said cathode, both said toroidal flows utilizing the same direction of flow in the space between said anode and said cathode.

22. An electrochemical device for recovering silver from waste photographic-fixer solution, comprising a generally cylindrical tank on an upstanding axis and having a bottom and sidewall, said tank having a predetermined upper level of liquid capacity, an open-ended stationary cylindrical cathode concentrically supported within said tank, said cathode being spaced from said bottom and sidewall and beneath said level, a stationary anode concentrically supported in radially spaced relation within said cathode, and rotary impeller means rotatable on said axis and positioned beneath said level to develop a recirculatory toroidal flow of liquid in said tank, the direction of operation of said impeller means being such as to induce upward flow in the space between said anode and cathode.

23. An electrochemical device for recovering silver from waste photographic-fixer solution, comprising a tank openable at its upper end and having a predetermined upper level of liquid capacity, a stationary hollow open-ended cylindrical first electrode positioned in said tank on an upstanding axis and located in clearance relation above the tank bottom and below said predetermined upper level; whereby when said tank is liquid-filled to said level, said first electrode toroidally divides said liquid into a radially inner zone and a radially outer zone with said zones freely liquid-connected at each of the axial ends of said first electrode; flow-impelling means spaced from and symmetrical about an upstanding axis which includes the axis of said electrode, said flow-impelling means being operable to generate a toroidal recirculating flow of liquid in opposite axial directions in said respective inner and outer zones, and a stationary cylindrical second electrode within and radially spaced from said first electrode and exposed to liquid in said inner zone.

24. The device of claim 23, in which the openable end of said tank includes a cover and means for removably securing and sealing the same in the tank-closed condition.

25. An electrochemical device for recovering silver from waste photographic-fixer solution, comprising an upwardly open tank having an upper spillway port determining a liquid-capacity level within the tank, said tank having an inlet port communicating directly with the bottom region within the tank, a hollow open-ended stationary cylindrical first electrode of stainless metal positioned in said tank on an upstanding axis and located in clearance relation above said bottom region and beneath said level; whereby when said tank is liquid-filled to said level, said first electrode toroidally divides the liquid into a radially inner zone and a radially outer zone with said zones freely liquid-connected at each of the axial ends of said first electrode; a stationary cylindrical second electrode of stainless metal within and concentrically surrounded by and radially spaced from said first electrode, and means for impressing a unidirectional plating potential upon said device by opposed-polarity connection to said respective electrodes, whereby said electrodes become anode and cathode, respectively, with plating action on the cathode and in the annular region between said electrodes, thereby locally reducing the density of solution between said electrodes as compared to local density of solution outside the outer electrode, so that in the course of plating at the cathode a toroidal circulation of solution may be induced upward between said electrodes and downward outside the outer electrode, and so that upwardly-flowing solution reaching the level of the top of said outer electrode may spill to the radially outer zone for recirculation downward in said radially outer zone.

26. An electrochemical device for recovering silver from waste photographic-fixer solution, comprising an upwardly open tank having an upper spillway determining a liquid-capacity level within the tank, a hollow open-ended stationary cylindrical first electrode of stainless metal positioned in said tank on an upstanding axis and located in clearance relation with said tank and beneath said level, a hollow open-ended stationary cylindrical second electrode of stainless metal in clearance relation with said tank and beneath said level, and concentrically surrounding and radially spaced from said first electrode, and flow-impelling means spaced from said electrodes and beneath said level for aid of toroidal recirculation of liquid flow upward in the space between said electrodes and downward both in the space within the inner electrode and in the space outside said outer electrode.

27. An electrochemical device for recovering silver from waste photographic-fixer solution, comprising an upwardly open tank having an upper spillway determining a liquid-capacity level within the tank, a hollow open-ended first cylindrical electrode of stainless metal positioned in said tank on an upstanding axis and located in clearance relation with said tank and beneath said level, a hollow open-ended second cylindrical electrode of stainless metal concentrically surrounding and radially spaced from said first electrode, said second electrode being also in clearance relation with said tank and beneath said level, and electroplating-potential supply means connected to said electrodes, thereby establishing one of said electrodes as a cathode and the other as an anode, with plating action developing on the cathode and in the annular zone between said anode and cathode, whereby the density of solution in said annular zone is locally reduced as compared to local density of solution in zones internal of and external to said annular zone, so that in the course of plating at the cathode a toroidal circulation of solution is induced upward in said annular zone between said anode and cathode and downward within said internal and external zones.

28. An electrochemical device for recovering silver from waste photographic-fixer solution, comprising an upwardly open tank having an upper spillway determining a liquid-capacity level within the tank, said tank having an inlet-port communicating directly with the bottom region within the tank, cylindrical anode of stainless metal positioned in said tank on an upstanding axis and extending beneath said level, a hollow open-ended cylindrical cathode of stainless metal concentrically surrounding and radially spaced from said anode, said cathode being in clearance relation with said tank and beneath said level, and electroplating-potential supply means connected to said anode and cathode, whereby plating action develops on the cathode and in the annular region between said anode and cathode, thereby locally reducing the density of solution between said anode and cathode as compared to local density of solution external to said cathode, so that in the course of plating at the cathode a toroidal circulation of solution is induced upward between said anode and cathode and downward external to said cathode, and so that upwardly-flowing solution reaching the level of the top of said cathode may spill to the space external of said cathode for recirculation downward within said space external to said cathode.

* * * * *